US005482530A

United States Patent [19]

Höhne

[11] Patent Number: 5,482,530

[45] Date of Patent: Jan. 9, 1996

[54] COBALT METAL POWDER AND COMPOSITE SINTERED ARTICLES PRODUCED THEREFROM

[75] Inventor: Matthias Höhne, Clausthal-Zellerfeld, Germany

[73] Assignee: H,C. Starck GmbH & Co. KG, Goslar, Germany

[21] Appl. No.: 348,610

[22] Filed: Dec. 2, 1994

[30] Foreign Application Priority Data

Dec. 21, 1993 [DE] Germany ..... 43 43 594.7

[51] Int. Cl.[6] ..... C22C 19/07

[52] U.S. Cl. ..... 75/230; 75/255; 75/331; 75/338; 75/343; 428/546; 428/552; 428/678

[58] Field of Search ..... 428/546, 552, 428/678; 75/230, 255, 331, 338, 343

[56] References Cited

U.S. PATENT DOCUMENTS

| | | | |
|---|---|---|---|
| 3,899,319 | 8/1975 | Lindskog et al. | 75/5 BA |
| 4,089,682 | 5/1978 | Saito et al. | 75/236 |
| 4,724,000 | 2/1988 | Larson et al. | 75/236 |
| 4,818,482 | 4/1989 | Poole et al. | 419/33 |
| 4,927,456 | 5/1990 | Kopatz et al. | 75/346 |
| 5,114,471 | 5/1992 | Johnson et al. | 75/346 |
| 5,250,101 | 10/1993 | Hidaka et al. | 75/362 |
| 5,338,508 | 8/1994 | Nitta et al. | 420/120 |
| 5,372,629 | 12/1994 | Anderson et al. | 75/332 |

FOREIGN PATENT DOCUMENTS

| | | |
|---|---|---|
| 0298593 | 1/1989 | European Pat. Off. . |
| 53-093165 | 8/1978 | Japan . |

*Primary Examiner*—Donald P. Walsh
*Assistant Examiner*—Scott T. Bluni
*Attorney, Agent, or Firm*—Jerry Cohen

[57] ABSTRACT

The invention relates to cobalt metal powders as a binder metal for the production of diamond and/or hard-metal tools and/or wear-resistant coatings and to composite sintered articles produced therefrom.

15 Claims, 4 Drawing Sheets

100 μm

COBALT METAL POWDER AND COMPOSITE SINTERED ARTICLES PRODUCED THEREFROM

BACKGROUND OF THE INVENTION

This invention relates to cobalt metal powder as a binder metal for the production of diamond and/or hard-metal tools and/or wear-resistant coatings and to composite sintered articles produced therefrom.

It is known that cobalt metal powder can be produced by atomization of the molten metal. Japanese patent application 53-093 165 describes the production and use of atomized cobalt metal. According to this document, a collected atomized crude product is treated by grinding and shock-tempering to obtain the desired hexagonal/cubic phase ratio. Grinding processes add to the cost of the cobalt metal powders, and are also a source of impurities.

Although cobalt metal powders can be produced extremely inexpensively by atomization from the melt, the powders obtained in this way are completely unsuitable as binder metals, for example for the production of diamond tools, because, they do not form dense composite sintered articles of sufficient hardness at typical sintering temperatures of 800° to 900° C. on account of the spheroidal particle shape and the particle size.

The unsatisfactory performance properties of hot-pressed composite sintered articles of atomized cobalt metal powder are mainly attributable to the inadequate compressibility of the prepressed blanks on account of the spheroidal particle shape, the relatively narrow particle size distribution and the coarse primary particles (FIG. 2). The necessary density of at least 8.5 g/cm$^3$ is not obtained by hot pressing either.

By contrast, cobalt metal powders with an FSSS (i.e. Fisher Subsieve Sizing Method; see e.g., American Society of Testing Materials (ASTM) Procedure No. B330 for a typical description of FSSS measuring procedure) value of 3 to 5 μm, so-called 400-mesh powders (FIG. 1 herein), suitable as a matrix material, can be obtained by reduction of oxygen-containing cobalt compounds with hydrogen at elevated temperature. These powders derive their name from the acceptance of the powder by a 400-mesh sieve. Powders such as these meet the requirements which the matrix metal for composite materials is expected to satisfy in terms of hardness and sinter density. However, 400-mesh powders have an extremely high percentage of impurities. It is generally known in this regard that aluminum, calcium, sodium, magnesium and silicon readily form stable oxides with the oxygen of the cobalt metal powder. These stable oxides can cause unwanted porosity in diamond segments.

In the case of hard metals, porosity-induced reductions in strength can occur if the impurities mentioned above and sulfur are present in excessive amounts. Accordingly, cobalt metal powders with low impurity contents are required for both applications. Depending on the amount of purification work carried out in the metallurgical preliminary stages, the purity of cobalt metal powders can be adapted to meet requirements. The expense involved in the production of particularly pure cobalt metal powders is of course considerable; powders such as these are therefore extremely expensive.

It is an object of the present invention to provide a cobalt metal powder which would not have any of the disadvantages of the powders described above.

SUMMARY OF THE INVENTION

A cobalt metal powder which exhibits the required properties has now been found. The present invention relates to a cobalt metal powder as a binder metal for the production of diamond and/or hard metal tools and/or wear-resistant coatings, characterized in that 20 to 80% by weight of the powder consists of an atomized cobalt metal powder with optically determined particle sizes of 5 to 150 μm, the balance to 100% by weight consisting of an optionally agglomerated cobalt metal powder with an optically determined primary particle size of less than 3 μm. Other objects, features and advantages will be apparent from the following detailed description of preferred embodiments taken in conjunction with the accompanying drawings in which:

BRIEF DESCRIPTION OF THE DRAWINGS

(FIG. 3—see Example 2) and a surface of a hot pressed article using two component cobalt powder (FIG. 4—see Example 2).

DETAILED DESCRIPTION OF PREFERRED EMBODIMENTS

Figure 1:
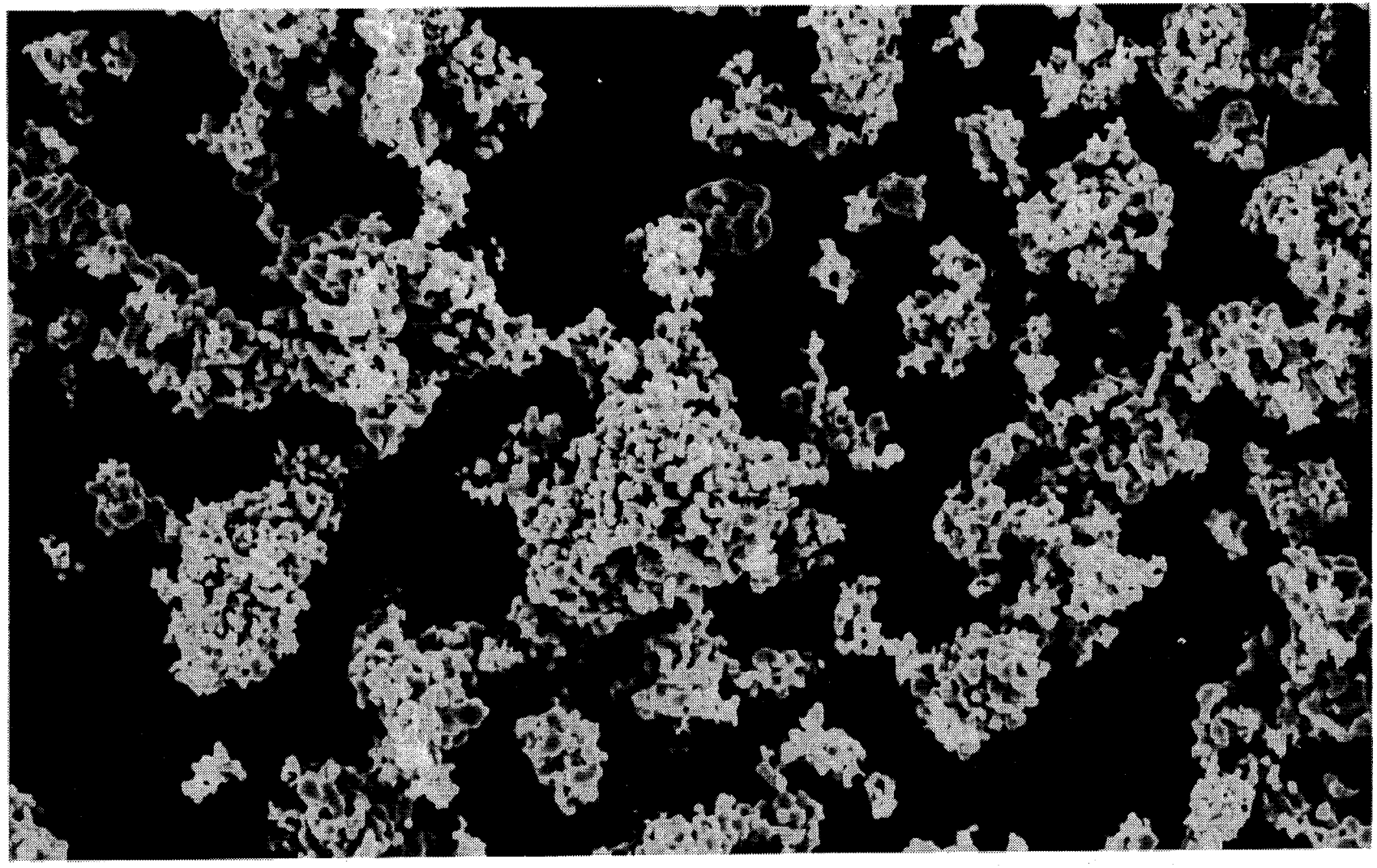
FIGS. 1–4 are SEM photomicrographs (1,000×20 KV) of prior art powders (FIG. 1-reduced cobalt oxide powders), water atomized cobalt powders (FIG. 2—see Examples 2, below) two component cobalt powder in accordance with a preferred embodiment of the invention.

The cobalt metal powder according to the invention has the price advantage of the cobalt metal powder obtained by reduction from oxides or oxygen-containing compounds, but contains much smaller quantities of the above-mentioned critical impurities. In a preferred embodiment, it contains less than 20 ppm of Al, 20 ppm of Ca, 30 ppm of Na, 20 ppm of Mg, 30 ppm of S and 75 ppm of Si.

The cobalt metal powder according to the invention is a mixture of atomized cobalt metal powder with fine cobalt powder from the reduction with hydrogen.

Although the high suitability of the cobalt metal powder according to the invention for technical applications actually begins at a content in the mixture of 20% by weight of atomized fine cobalt metal powder from the reduction with hydrogen, an upper limit to this content of up to 80% by weight is still acceptable from the price advantage point of view. The powder-metallurgical behavior of the mixtures is also very favorable within the limits mentioned.

The quantity of atomized cobalt metal powder is preferably from 30 to 70% by weight. Both a water-atomized cobalt metal powder which is predominantly spheroidal and a gas-atomized cobalt metal powder which is predominantly spheroidal are suitable as the atomized cobalt metal powder.

The crystalline cobalt metal powder preferably has BET (i.e. the well-known Brunares-Emmet-Teller method of powder surface area measurement) surfaces, as determined by the nitrogen 1-point method (DIN 66 131), of greater than 0.8 m$^2$/g. In one preferred embodiment, the cobalt metal powder according to the invention has an apparent density of less than 1.4 kg/cm$^3$. DIN refers to Deutsche Industrie Norm (German Industrial Standard) for standards adopted in Germany but used world-wide and correspondence to standards adopted through U.S. NTIS (National bureau of Standards) and ASTM procedures. DIN standard 66131 and 66152 referred to herein is a well known implementation of powder surface measurement processing based on the fundamental BET method.

By virtue of the favorable particle size distribution of the cobalt metal powder according to the invention, a density of at least 8.5 g/cm$^3$ is obtained after hot pressing so that the powder is characterized by excellent compressibility. In another preferred embodiment of the cobalt metal powder according to the invention, the powder has a Rockwell hardness, as measured on hot-pressed test plates, of at least 98 $HR_B$.

The cobalt metal powder according to the invention is eminently suitable for the powder-metallurgical production of diamond tools and/or hard metals in which the cobalt—optionally together with other typical matrix metals—represents the binder phase.

Accordingly, the present invention also relates to composite sintered articles produced from hard-metal powder and/or diamond powder and binder metals, the cobalt metal powder according to the invention being used—optionally together with other metal powders—as the binder metal.

The following Examples are intended to illustrate the invention without limiting it in any way.

EXAMPLE 1

(70:30 mixture)

Figure 2:
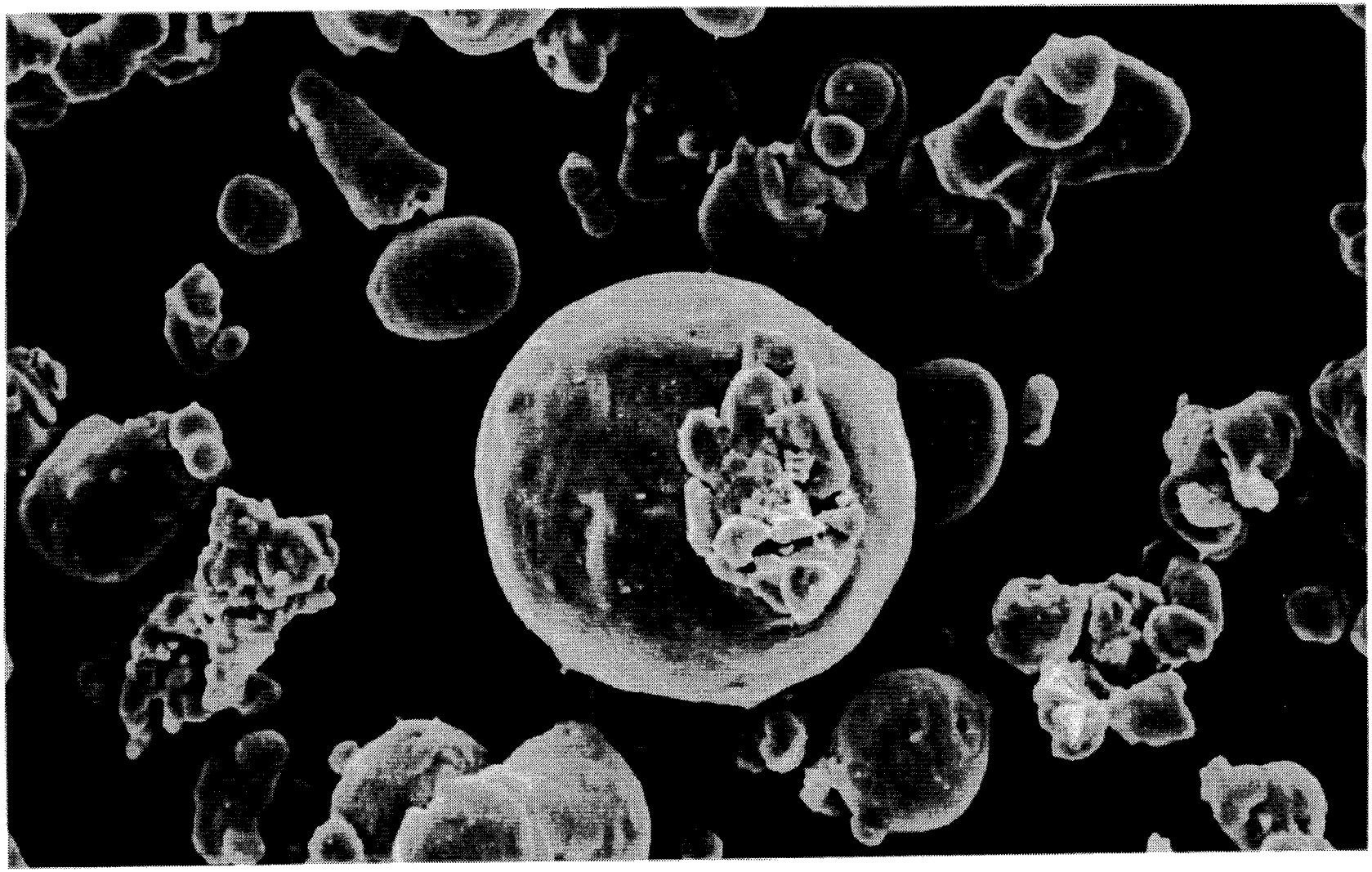

0.7 kg of a fine cobalt metal powder (from the reduction of cobalt oxide with hydrogen) with an average particle size of 1.7 μm, sieved through a 63 μm sieve with an apparent density of 1.2 g/cm$^3$ (FIG. 1), was mixed for 1 hour in a "Turbula" mixer with 0.3 kg of a water-atomized cobalt metal powder (11.7 μm FSSS) sieved through a 38 μm with an apparent density of 3.3 g/cm$^3$ (FIG. 2). The product thus obtained had an FSSS value of 2.2 μm and an apparent density of 0.73 g/cm$^3$. The content of critical impurities by comparison with a 400-mesh cobalt metal powder according to the prior art was distinctly reduced (Table 2).

Sintering test

For the sintering test, the mixed powder was introduced into an approximately 30 mm diameter round graphite mold and hot-pressed under the following conditions:

Heating gradient: 180 K/min.

Sintering temperature: 830° C. (as measured in the graphite mold)

Sintering pressure: 350 N/mm$^2$

Holding time: 3 mins.

The test plate thus obtained had a final density of 8.54 g/cm$^3$ and a hardness (Rockwell B) of 101.6 $HR_B$.

EXAMPLE 2

(60:40 mixture)

Figure 3:
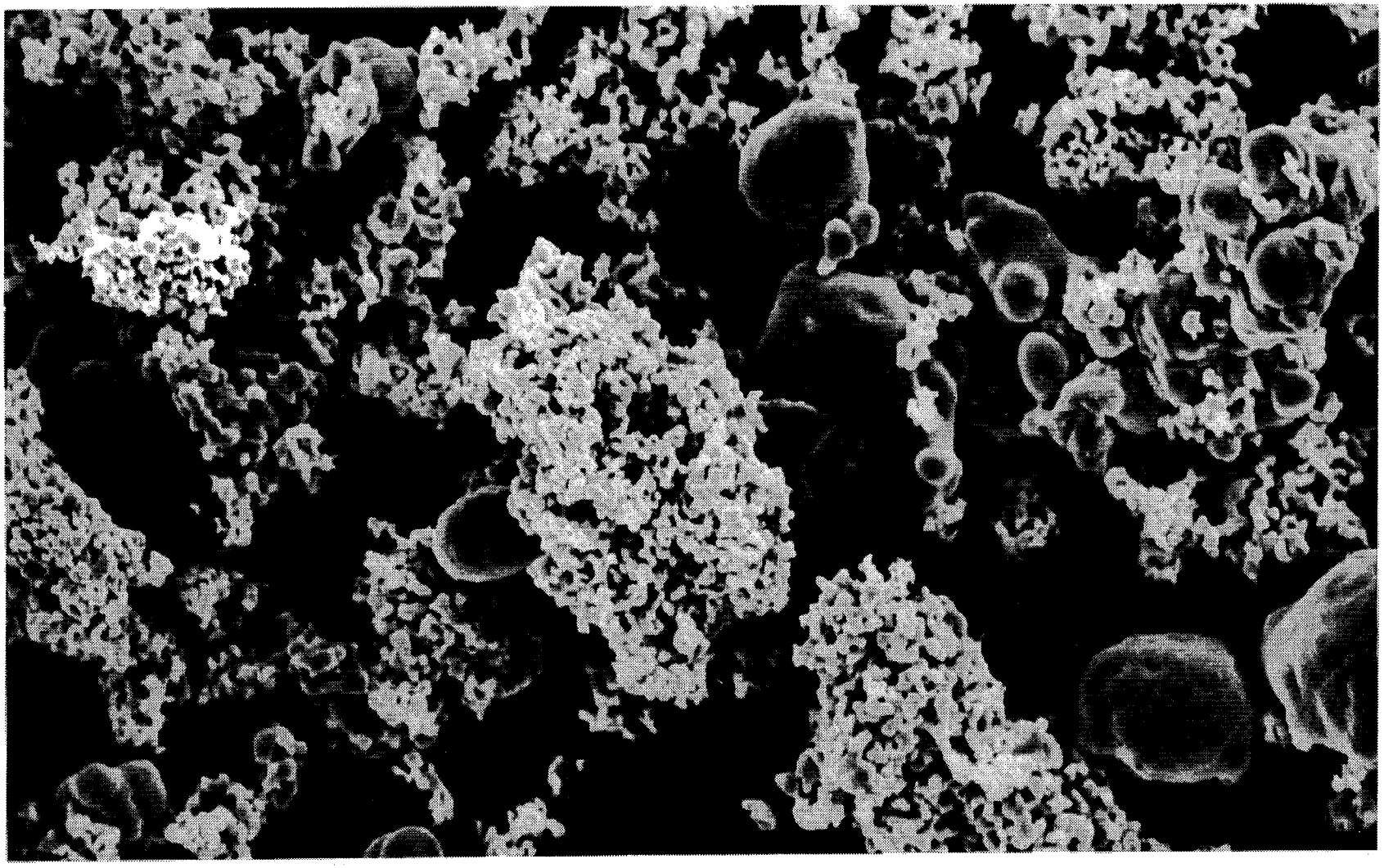

0.6 kg of a fine cobalt metal powder with a BET surface of 1.11 m$^2$/g and an average particle size of 1.7 μm (FSSS), sieved through a 63 μm sieve with an apparent density of 1.2 g/cm$^3$ (FIG. 1), was mixed for 60 minutes in a plowshare mixer with 0.4 kg of a water-atomized cobalt metal powder (11.7 μm FSSS) with a BET surface of 0.73 m$^2$/g, as determined by the nitrogen 1-point method (DIN 66 131), sieved through a 38 μm sieve with an apparent density of 3.3 g/cm$^3$ (FIG. 2). The cobalt metal powder obtained (FIG. 3) had an FSSS value of 2.6 μm, a BET surface of 0.74 m$^2$/g and an apparent density of 0.8 g/cm$^3$. The content of chemical impurities by comparison with a typical 400-mesh cobalt metal powder is distinctly reduced (Table 2).

Figure 4:
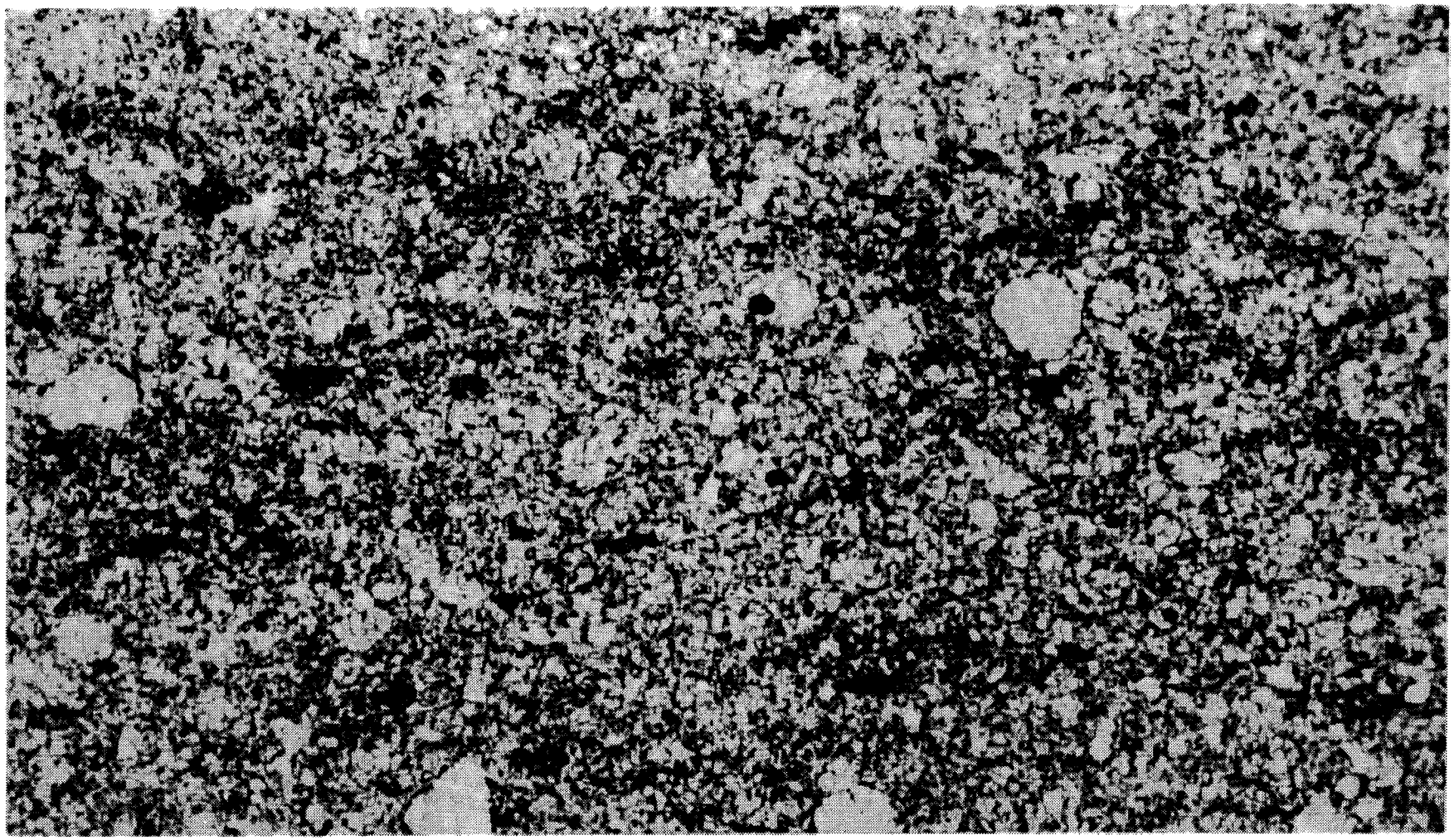

A test plate hot-pressed as described in Example 1 had a density of 8.54 g/cm$^3$ and a hardness 101.2 $HR_B$. FIG. 4 clearly shows that, in the polished and etched sample, large round cobalt particles have remained intact among fine primary crystals.

EXAMPLE 3

(50:50 mixture)

0.5 kg of a fine cobalt metal powder (obtained from the reduction of cobalt hydroxide) with an average particle size of 0.9 μm and a BET surface of 1.85 m$^2$/g, sieved through a 100 μm sieve (apparent density 0.8 g/cm$^3$), was mixed for 15 minutes in a "Turbula" mixer with 0.5 kg of a water-atomized cobalt metal powder (11.7 μm FSSS) with a BET surface of 0.73 m$^2$/g. The mixture obtained had an FSSS value of 1.5 μm FSSS and a BET surface of 1.06 m$^2$/g for an apparent density of 0.8 g/cm$^3$.

A hardness of 100.4 $HR_B$ and a density of 8.5 g/cm$^3$ were measured as in Example 1 on a hot-pressed sample plate.

Comparison Example 1

(100% water-atomized cobalt metal powder <63 μm)

Pure water-atomized cobalt metal powder, sieved through a 63 μm sieve, with an FSSS value of 12 μm was hot-pressed as in Example 1, the hot-pressing temperature being varied. The following hardness values were determined on the test plates thus obtained:

Sinter test by hot pressing:

Heating gradient: 180 K/min.

Sintering pressure: 350 N/mm$^2$

Holding time: 3 mins.

| Sintering temperature | Hardness values ($HR_B$) | Density |
|---|---|---|
| 800° C. | Pressing disintegrates, hardness cannot be measured | n.d. |
| 850° C. | 25 | 7.0 |
| 900° C. | 40 | 7.5 |
| 950° C. | 47 | 7.8 |

In no case was it possible with tile atomized cobalt metal powder to achieve the required minimum density of 8.5 g/cm$^3$ or the minimum hardness of 98 $HR_B$.

EXAMPLE 5

(100% water-atomized cobalt metal powder <38 μm)

Pure water-atomized cobalt metal powder, sieved through a 38 μm sieve (FIG. 2), with an FSSS value of 11.8 μm, was hot-pressed under the conditions described in Example 1, a hardness of 80 $HR_B$ being measured on the test plates.

Despite this even finer sieving, it was not possible to achieve the required minimum density or minimum hardness.

The data of Examples 1 to 3 and the comparison data relating to the 400-mesh cobalt powder and the atomized powder (according to the prior art) are set out in Table 1.

TABLE 1

(Hardness test results)
Hot-pressing temperature Sinter densifies/Rockwell hardness ($HR_B$)

| °C. | Atomized Co powder Example 5 | Mixture of Example 1 (70/30) | Mixture of Example 2 (60/40) | Mixture of Example 3 (50/50) | Co 400 mesh Prior art |
|---|---|---|---|---|---|
| 830 | 8.1 g/cm$^3$<br>80 $HR_B$ | 8.54 g/cm$^3$<br>101.6 $HR_B$ | 8.54 g/cm$^3$<br>101.2 $HR_B$ | 8.5 g/cm$^3$<br>100 $HR_B$ | 8.45<br>97.7 $HR_B$ |

Comparison Example (400 mesh powder)

Table 2: Comparative data of critical impurities in cobalt metal powders

The content of critical impurities was distinctly reduced by comparison with a typical 400-mesh cobalt metal powder (Table 2).

Impurities in 400-mesh cobalt (400-mesh cobalt metal powder ("Cobalt Powder 400-mesh", a product of Hoboken Overpelt, Belgium)) and the mixtures of Examples 1, 2 and 3 according to the invention:

| Impurities | 400 Mesh Co (100/0) | Mixture of Example 1 (70/30) | Mixture of Example 2 (60/40) | Mixture of Example 3 (50/50) |
|---|---|---|---|---|
| Al (ppm) | 180 | 6 | 7 | 6 |
| Ca (ppm) | 320 | 12 | 12 | 13 |
| Na (ppm) | 55 | 25 | 22 | 9 |
| Mg (ppm) | 150 | 8 | 8 | 3 |
| S (ppm) | 140 | 13 | 14 | 15 |
| Si (ppm) | 310 | 34 | 36 | 41 |

I claim:

1. A two component, crystalline cobalt metal powder usable as a binder metal for the production of diamond and hard metal tools and wear-resistant coatings, respectively characterized in that (a) the first component, 20 to 80% by weight of the two components of the powder, consists essentially of an atomized cobalt metal powder with optically determined particle sizes of 5 to 150 μm, (b) the balance to 100% by weight of the two components consisting essentially of a second component, which is a reduced cobalt metal powder with an optically determined particle size of less than 3 μm.

2. A cobalt metal powder as claimed in claim 1, characterized in that the quantity of atomized cobalt metal powder is from 30 to 70% by weight.

3. A cobalt metal powder as claimed in either of claims 1 or 2 characterized in that the second component is agglomerated.

4. A cobalt metal powder as claimed in claim 3, characterized in that the crystalline cobalt metal powder has BET surfaces, as determined by the nitrogen 1 -point method (DFN 66131), of greater than 0.8 m$^2$/g.

5. A cobalt metal powder as claimed in claim 4 characterized in that the atomized cobalt component is predominantly spheroidal.

6. A cobalt metal powder as claimed in either of claims 1 or 2, characterized in that the atomized cobalt metal powder is a water-atomized cobalt metal powder which is predominantly spheroidal.

7. A cobalt metal powder as claimed in either of claims 1 or 2, characterized in that the atomized cobalt metal powder is a gas-atomized cobalt metal powder which is predominantly spheroidal.

8. A cobalt metal powder as claimed in either of claims 1 or 2, characterized in that it has an apparent density of less than 1.4 g/cm$^3$.

9. A cobalt metal powder as claimed in either of claims 1 or 2, characterized in that the powder as a whole contains less than 20 ppm of aluminum, less than 20 ppm of calcium, less than 30 ppm of sodium, less than 20 ppm of magnesium, less than 30 ppm of sulfur and less than 75 ppm of silicon.

10. A cobalt metal powder as claimed in either of claims 1 or 2, characterized in that it is capable of exhibiting a Rockwell hardness, as measured on hot-pressed test plates made from the powder, of at least 98 $HR_B$.

11. Composite sintered articles with a reinforcing phase and binder, the reinforced phase selected from the group consisting of hard-metal powder and diamond powder, the binder comprising the cobalt metal powder as claimed in either of claims 1 or 2.

12. A cobalt metal powder with an apparent density of less than 1.4 g/cm$^3$, characterized in that it is capable of exhibiting a Rockwell hardness as measured in hot-pressed test plates made from the powder, of at least 98 $HR_B$, said powder further characterized by an impurity level of less than 20 ppm of aluminum, 20 ppm of calcium, 30 ppm of sodium, 20 ppm of magnesium, 30 ppm of sulfur and 75 ppm of silicon, said powder having BET surfaces, as measured by the nitrogen 1-point method (DIN 66132), of greater than 0.8 m$^2$/g, said powder consisting essentially of 20 to 80% by weight of an atomized cobalt component and the balance to 100% being a cobalt metal product of cobalt oxide reduction.

13. The cobalt metal powder of claim 12 wherein the atomized component is predominantly spheroidal.

14. The cobalt metal powder of either of claims 12 or 13 wherein the weight percent of atomized component is 30 to 70.

15. Composite sintered articles with a reinforcing phase and binder, the reinforcing phase selected from the group consisting of hard-metal powder and diamond powder, the binder comprising the cobalt metal powder as claimed in either of claims 12 or 13.

* * * * *